US005553956A

United States Patent [19]

Mitsuya et al.

[11] Patent Number: 5,553,956

[45] Date of Patent: Sep. 10, 1996

[54] STICK-SHAPED MATERIAL PROPELLING DEVICE

[75] Inventors: Yoshihide Mitsuya; Shoji Anzai, both of Kawagoe, Japan

[73] Assignee: Kotobuki & Co., Ltd., Kyoto-hu, Japan

[21] Appl. No.: 249,938

[22] Filed: May 26, 1994

[30] Foreign Application Priority Data

Feb. 23, 1994 [JP] Japan ..... 6-025571

[51] Int. Cl.[6] ..... A45D 40/06

[52] U.S. Cl. ..... 401/68; 401/75; 401/76

[58] Field of Search ..... 401/68, 75, 76, 401/79

[56] References Cited

U.S. PATENT DOCUMENTS

| | | | |
|---|---|---|---|
| 1,490,245 | 4/1924 | Wahl | 401/76 |
| 3,115,118 | 12/1963 | Anderson et al. | 401/175 |
| 3,209,730 | 10/1965 | Aston | 401/76 |
| 3,289,636 | 12/1966 | Tessier | 401/75 |
| 3,333,689 | 8/1967 | Terrill et al. | 401/76 |
| 5,018,892 | 5/1991 | Krueckel et al. | 401/75 X |

*Primary Examiner*—Steven A. Bratlie
*Attorney, Agent, or Firm*—David O'Reilly

[57] ABSTRACT

A stick-shaped material propelling device is comprised of a first tubular body and a spiral shaft inserted in the first tubular body. The spiral shaft has a spiral groove on the circumference of spiral shaft and an integral guide portion at a rear portion of the spiral shaft. The guide portion engages an inside portion of the first tubular body so that the guide portion is unturnable, but is movable in the axial direction relative to the first tubular body. A holder for holding a stick-shaped material is provided at a front portion of the spiral shaft. A second tubular body is turnably mounted on the first tubular body. The second tubular body has a projection on the inside of a rear portion of second tubular body. The spiral shaft and the holder are inserted into the second tubular body so as to be able to slide in the second tubular body with the projection engaging the spiral groove. At least one slit is formed around the projection on the second tubular body or in an end portion of the spiral shaft.

14 Claims, 4 Drawing Sheets

STICK-SHAPED MATERIAL PROPELLING DEVICE

BACKGROUND OF THE INVENTION

1. Field of the Invention

The present invention relates to a stick-shaped material propelling device in which a stick-shaped material such as a retouching stick, a color stick, a stick-shaped paste, a stick-shaped eraser, a rouge, an eyebrow substance, a lead, a paste, and the like can be selectively extended from and retracted into the stick-shaped propelling device by a turning operation.

2. Background Information

FIG. 6 shows an example of a conventional stick-shaped material propelling device.

A conventional stick-shaped material propelling device comprises first tubular body 1 and spiral shaft 5 having spiral groove 6 on its circumference inserted in first tubular body 1. Guide member 20 is connected with a rear end portion of spiral shaft 5. Guide member 20 is inserted in first tubular body 1 so as to be unturnable, but movable in the axial direction relative to first tubular body 1. Holder 4 holding stick-shaped material 3, is connected with a front portion of spiral shaft 5. Second tubular body 2 is inserted in first tubular body 1 so as to be turnable relative to first tubular body 1. Spiral shaft 5 and holder 4 are inserted in second tubular body 2 so they can slide in second tubular body 2. Projection 7A formed in the inside of a rear portion of second tubular portion 2 engages spiral groove 6.

In the above described conventional stick-shaped material propelling device, when second tubular body 2 is turned relative to first tubular body 1, since projection 7A of second tubular body 2 engages spiral groove 6 of spiral shaft 5 and guide member 20 is inserted into first tubular body 1 so as to be unturnable relative to first tubular body, spiral shaft 5 and holder 4 connected with spiral shaft 5 move in the axial direction in second tubular body 2 so that stick-shaped material 3 held by holder 4 is extended from or retracted into the front end portion of second tubular body 2 according to the direction second tubular body 2 is turned.

However, in the above described conventional example, the problem is that many parts are required so that production costs are increased, because spiral shaft 5 and guide member 20 are two different members.

SUMMARY OF INVENTION

Accordingly, it is an object of the present invention to provide a stick-shaped material propelling device in which the number of parts can be reduced, and assembling thereof can be easily carried out.

In order to achieve the object of the present invention, a stick-shaped material propelling device comprises a first tubular body, and a spiral shaft inserted in the first tubular body. The spiral shaft has a circumferential spiral groove and an integral guide portion at a rear portion of the spiral shaft. The guide portion engages an inside portion of the first tubular body so that the guide portion is unturnable, but is movable in an axial direction relative to the first tubular body. A holder for holding stick-shaped material is provided at a front portion of the spiral shaft. A second tubular body is turnably mounted on the first tubular body and has a projection on an inside of a rear portion of the second tubular body. The spiral shaft and the holder are inserted into the second tubular body so they can slide in the second tubular body with the projection of the second tubular body engaging the spiral groove. At least one slit is formed around the projection of the second tubular body and or is formed in an end portion of the spiral shaft.

In the present invention, when the guide portion of the spiral shaft has at least one key, at least one axial key groove is formed on the inside portion of the first tubular body to receive the key of the guide portion.

Further, in the present invention, when the guide portion of the spiral shaft has at least one axial key groove, at least one key is formed on the inside portion of the first tubular body to engage the key groove of the guide portion.

Further, in the present invention, when the key groove of the guide portion is the slit formed at the rear end portion of the spiral shaft, the key of the first tubular body fits into the slit so that the guide portion is unturnable, but is movable in the axial direction relative to the first tubular body.

Further, in the present invention, when the key groove of the guide portion is comprised of the slit formed at the rear end portion of the spiral shaft and a groove formed in the side of the spiral shaft so as to communicate with the slit, the key of the first tubular body fits into the slit and groove so that the guide portion is unturnable, but is movable in the axial direction relative to the first tubular body.

In the present invention, since the guide member is an integral part of the spiral shaft, the number of parts is decreased so that the production costs are reduced.

In assembling the stick-shaped material propelling device, when making the projection of the second tubular body engage the spiral groove of spiral shaft, it may be thought to be difficult to assemble them, because the guide portion is an integral part of the spiral shaft. However, according to the present invention, it is possible to allow projection to displace outward or the spiral shaft to bend inward in the radial direction, since flexibility is provided to a portion around the projection of the second tubular body or at an end portion of the spiral shaft by the existence of the slit. Therefore the projection of the second tubular body can extend beyond the side of the spiral shaft so that the projection reaches the spiral groove of the spiral shaft. Thus, the stick-shaped material propelling device can be easily assembled.

When the slit is formed in the rear end portion of the spiral shaft, the slit acts as the guide portion or acts as a part of the guide portion. The key provided in the first tubular body engages the slit so that the guide portion is unturnable, but is movable in the axial direction in the first tubular body.

Other objects and advantages of the invention will become more apparent from the following portion of this specification and from the accompanying drawings.

DETAILED DESCRIPTION OF THE PREFERRED EMBODIMENTS

Figure 1:
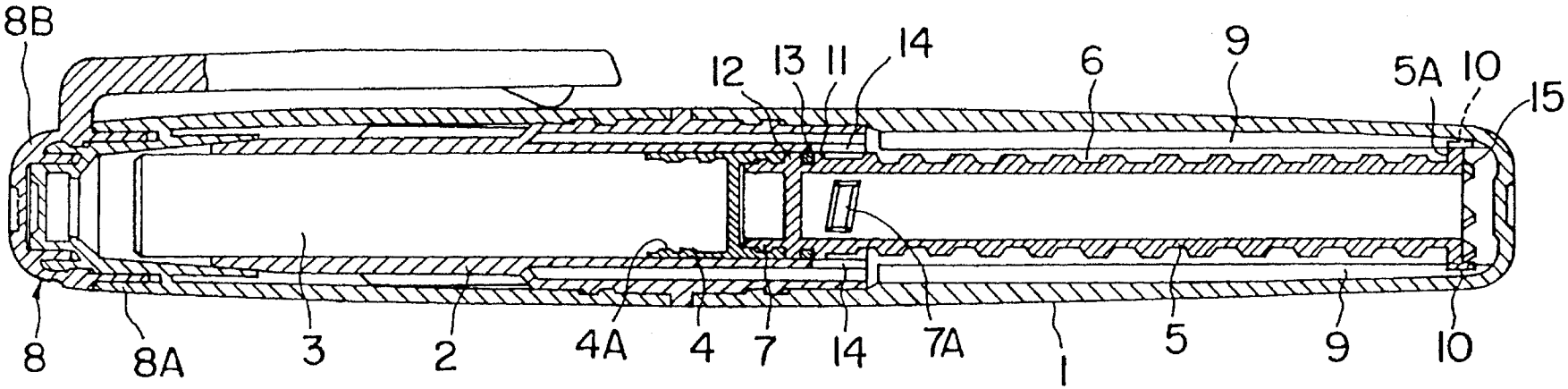
FIG. 1 is a vertical sectional view of one embodiment of a stick-shaped material propelling device according to the present invention.

Referring to FIG. 1, a stick-shaped material propelling device comprises first tubular body 1 with spiral shaft 5 inserted in first tubular body 1 . Spiral shaft 5 has a circumferential spiral groove 6 and an integral guide portion 5A at the rear end portion of spiral shaft 5.

Guide portion 5A of spiral shaft 5 is inserted in first tubular body 1 so that guide portion 5A is unturnable, but is movable in an axial direction to first tubular body 1. In this embodiment, the inside of first tubular body 1 or the periphery of the end plate of guide portion 5A, for example, has a plurality of key grooves 10, while two keys 9 are formed on the peripheral portion of the inside of first tubular body 1 corresponding to two key grooves 10. Rear end portions of ridges 15 between key grooves 10 have a triangular shape as shown in FIG. 1.

Connecting portion 7 is provided at a front portion of spiral shaft 5. Holder 4 is removably connected with connecting portion 7. Stick-shaped material 3 is grasped and held by female screw threads 4A of holder 4. First collar 11 and second collar 12 are formed on the outside of a front portion of screw shaft 5. Second collar 12 contacts the rear end of holder 4 and O ring 13 is disposed between first collar 11 and second collar 12.

Figure 2A:
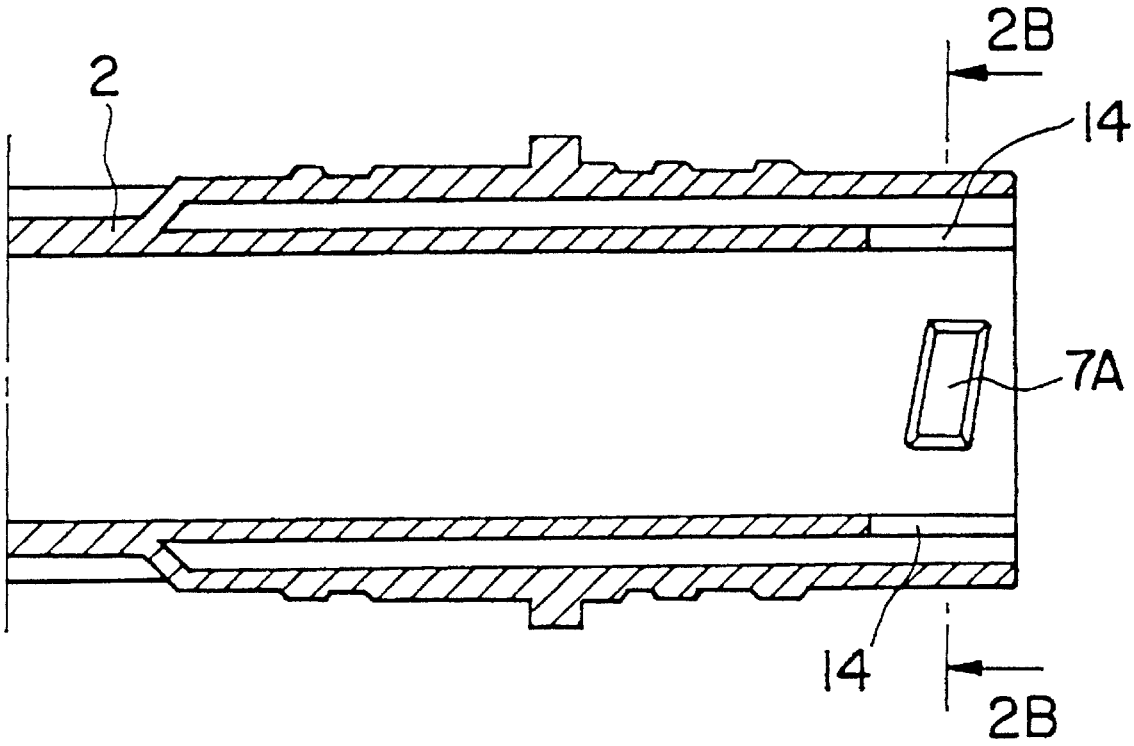
FIG. 2(A) is a partial sectional view of a second tubular body shown in FIG. 1.
Figure 2B:
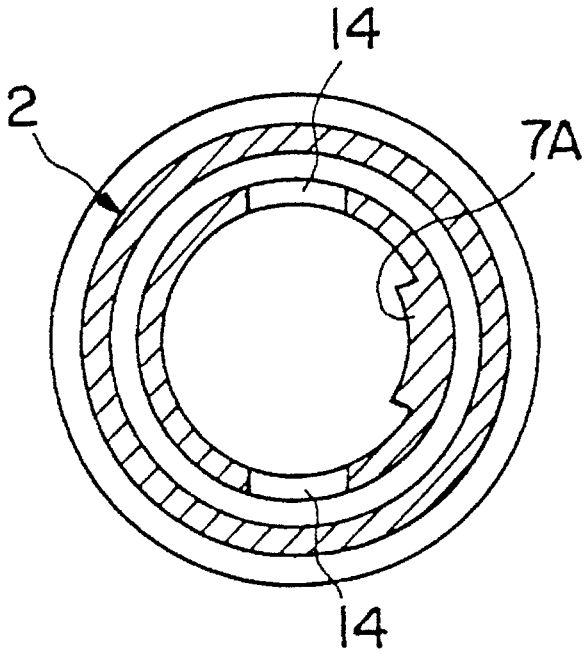
FIG. 2(B) is a sectional view taken at 2B—2B of FIG. 2(A)

Second tubular body 2 is turnably mounted on first tubular body 1. Spiral shaft 5 and holder 4 are inserted in second tubular body 2 so they can slide in second tubular body 2. Projection 7A formed on the inside of a rear portion of second tubular body 2 engages spiral groove 6. As shown in FIG. 2, projection 7A is formed on the inner periphery of second tubular body 2 and two spaced axial slits 14, 14 are formed at angular intervals ±90° to projection 7*a*. Axial slits 14 extend in the axial direction of second tubular body 2.

Cap 8 comprised of outer cap 8A and inner pipe 8B is removably attached to first tubular body 1 and/or second tubular body 2, for example, the top of second tubular body 2.

The operation of the above described stick-shaped material propelling device according to the present invention is explained as follows. When using the stick-shaped material propelling device, cap 8 is removed from first tubular body 2. If second tubular body 2 is rotated relative to first tubular body 1, since projection 7A of second tubular body 2 engages spiral groove 6, and keys 9 of first tubular body 1 engage key grooves 10 of guide portion 5A of spiral shaft 5, projection 7A moves along spiral groove 6, while spiral shaft 5 is moved in the axial direction of first tubular body 1 by the engagement of keys 9 with key grooves 10. As a result stick-shaped material 3 held by holder 4, connected with spiral shaft 5 through connecting portion 7, extends from the top of second tubular body 2.

Otherwise, if first tubular body 1 is rotated relative to second tubular body 2, since keys 9 of first tubular body 1 engage key grooves 10 of guide portion 5A and projection 7A of second tubular body 2 engages spiral groove 6 of spiral shaft 5, spiral shaft 5 and holder 4 connected with connecting portion 7 of spiral shaft 5 are moved in an axial direction as spiral shaft 5 turns. As a result stick-shaped material 3 held by holder 4 is extended from the top of second tubular body 2 for use.

In order to retract stick-shaped material 3 into second tubular body 2, second tubular body 2 is turned relative to first tubular body 1, or first tubular body 1 is turned relative to second tubular body 2, in a direction opposite to the aforesaid direction so that projection 7A moves along spiral groove 6 in a direction opposite to the aforesaid direction, while spiral shaft 5 and holder 4 move in a direction opposite to the aforesaid direction to retract stick-shaped material 3 held by holder 4 into second tubular body 2.

In the present embodiment, since spiral shaft 5 is integrally formed with guide portion 5A, the number of parts is reduced so that the cost of production is reduced.

Assembling the stick-shaped material propelling device of the present embodiment is explained as follows.

First, under the condition in which O ring 13 is inserted between first collar 11 and second collar 12, projection 7A of second tubular body 2 is engaged with spiral groove 6 on spiral shaft 5. In this way, since guide portion 5A is an integral part of a rear portion of spiral shaft 5, the front portion of spiral shaft 5 must be inserted into second tubular shaft 2 from the rear of second tubular body 2. When spiral shaft 5 is inserted into second tubular body 2, there is a concern that projection 7A and first and second collars 11, 12 will interfere each other. However, projection 7A can move outward in a radial direction, because flexibility is provided on a portion of second tubular body 2 near projection 7A by slits 14, 14 existing in second tubular body 2. Accordingly, projection 7A can pass over first and second collars 11, 12 to engage spiral groove 6 in spiral shaft 5. Spiral shaft 5 is inserted into first tubular body 1 so that key grooves 10 of guide portion 5A engage keys 9, as spiral shaft 5 with second tubular shaft 2 are inserted together.

When keys 9 are inserted into key grooves 10, if the angular positions of keys 9 do not coincide with angular positions of key grooves 10, key grooves 10 are guided by the triangular edges formed at the rear end of ridges 15 between adjacent key grooves 10.

Holder 4 which holds stick-shaped material 3 is then connected with connecting portion 7, and thereafter cap 8 is attached to the top of second tubular body 2.

As described above, since the stick-shaped material propelling device of the present invention includes slits 14, it can be easily assembled.

Further, the following effects are shown from the existence of slits 14. There is a possibility that a user will forcibly continue to turn first tubular body 1 relative to second tubular body 2 notwithstanding stick-shaped material 3 is in the outermost position thereof or in the innermost position thereof. That is, notwithstanding projection 7A reaching the farthest end portions of spiral groove 6, without the user becoming aware of it. Even in such a situation, since the stick-shaped material propelling device of the present invention has slits 14, projection 7A may distort outward in the radial direction to pass over ridges between the grooves at the farthest ends of spiral groove 6. Therefore, spiral shaft 5 will freely rotate relative to second tubular body 2, preventing spiral groove 6 or projection 7A of second tubular body 2 from being broken.

Figure 3:
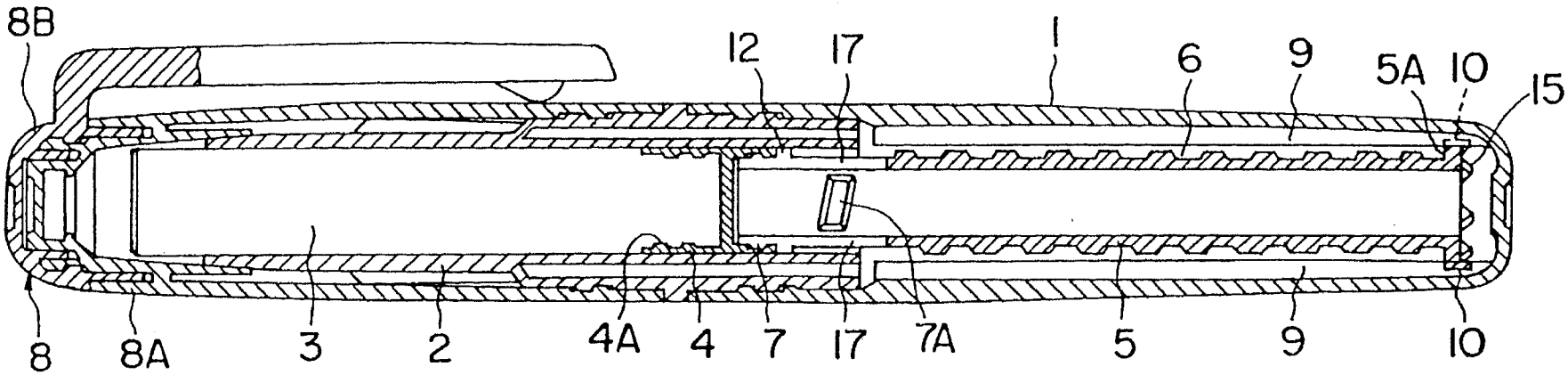
FIG. 3 is a vertical sectional view of a second embodiment of a stick-shaped material propelling device according to the present invention.

FIG. 3 shows a second embodiment of a stick-shaped material propelling device according to the present invention.

In this embodiment, instead of slits 14 of second tubular body 2 as in the previous embodiment, a pair of slits 17 are formed at the front end portion of spiral shaft 5, and first collar 11 and O ring 13 are omitted.

In this embodiment, when projection 7A of second tubular body 2 engages spiral groove 6 of spiral shaft 5, the front end portion of spiral shaft 5 bends inward in a radial direction so that projection 7A can pass over collar 12 to enter spiral groove 6.

Accordingly, in the same manner as the first embodiment, it can be easily assembled.

Further, in this embodiment, when a user continues to forcibly turn first tubular body 1 relative to second tubular body 2 notwithstanding stick-shaped material 3 is in the innermost position thereof, spiral shaft 5 can bend inward in the radial direction, and freely rotate relative to second tubular body 2, preventing spiral groove 6 or projection 7A from being broken.

Figure 4:
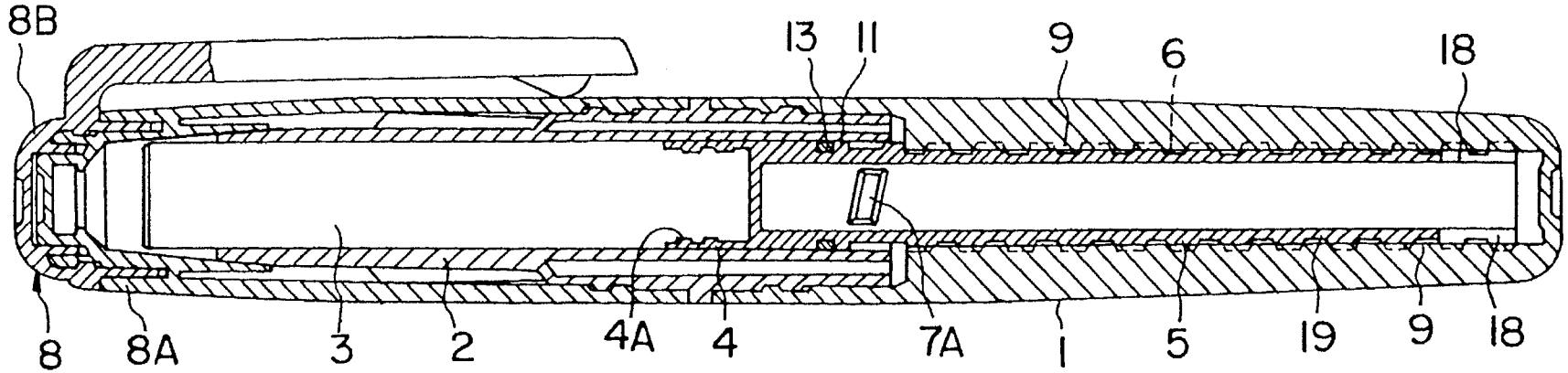
FIG. 4 is a vertical sectional view of a third embodiment of a stick-shaped material propelling device according to the present invention.

FIG. 4 shows a third embodiment of the stick-shaped material propelling device according to the present invention.

Figure 5:
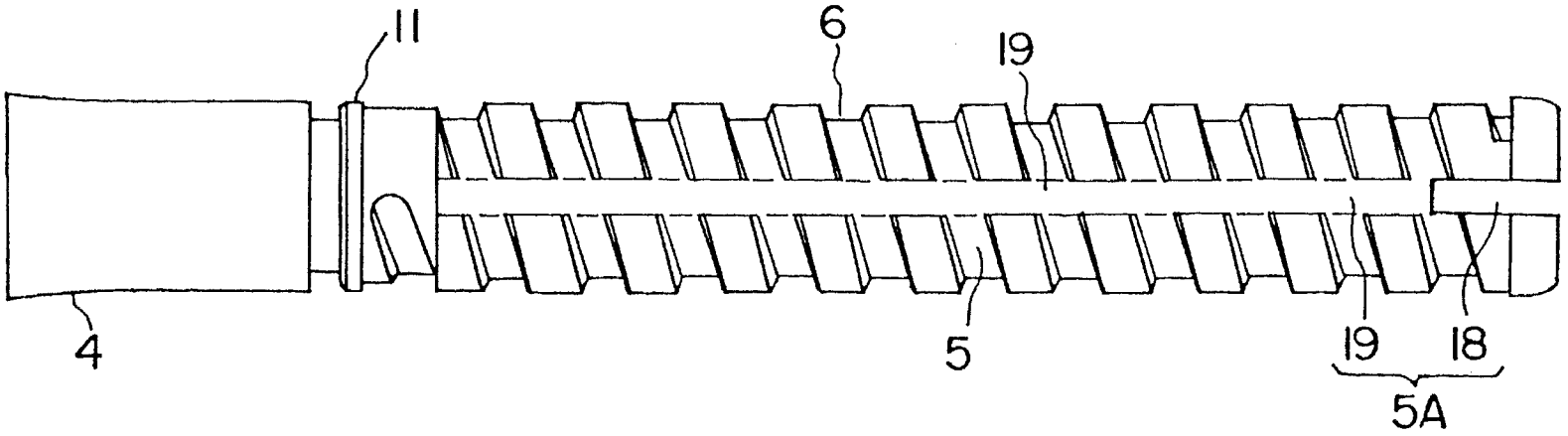
FIG. 5 is a plan view of the spiral shaft shown in FIG. 4.
Figure 6:
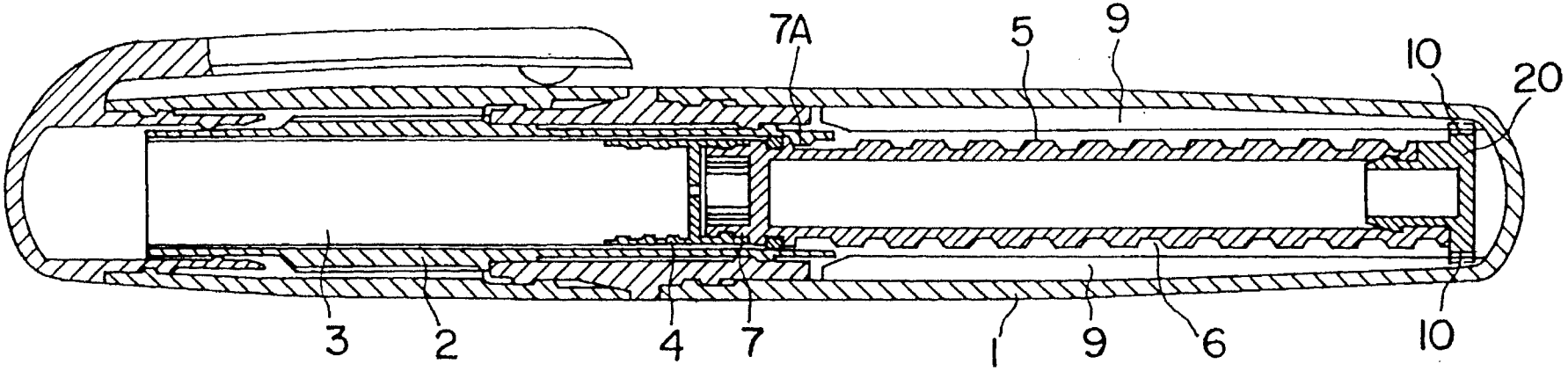
FIG. 6 (PRIOR ART)
FIG. 6 is a vertical sectional view of a conventional stick-shaped material propelling device.

In this embodiment, a pair of slits 18 are formed in the rear end portion of spiral shaft 5 and includes a pair of key grooves 19 communicating with slits 18 (as shown in FIG. 5). Guide portion 5A is comprised of the key grooves 19 and slits 18.

In this embodiment, when making projection 7A of second tubular body 2 engage spiral groove 6 of spiral shaft 5, the rear end portion of spiral shaft 5 can be inserted into second tubular body 2 from the front portion of second tubular body 2 and projection 7A can enter spiral groove 6, since the existence of slits 18 enables the rear end portion of spiral shaft 5 to bend inward.

Further, when a user continues to forcibly turn first tubular body 1 relative to second tubular body 2 notwithstanding stick-shaped material 3 is in the outermost position thereof, spiral shaft 5 bends inward in a radial direction, causing idle rotation of spiral shaft 5 relative to second tubular body 2.

Slits 18 in this embodiment have another operation as well as the aforesaid operation. Namely they prevent spiral shaft 5 and first tubular body 1 from turning relative to each other because keys 9 of first tubular body 1 are inserted in slits 18 and key grooves 19.

In this embodiment, since it is possible to insert the rear portion of spiral shaft 5 into second tubular body 2 from the front portion thereof in assembling, holder 4 may be an integral part of spiral shaft 5 ( FIG. 5).

Further, in this embodiment, guide portion 5A can be comprised of only slits 18 by using longer slits instead of key grooves 19. In this case, when the length of a stick-shaped material to be propelled is short, slit 18 need not extend to the front portion of spiral shale 5. Extending slit 18 to about midway of spiral shaft 5 is sufficient to provide guide portion 5A.

The embodiments described hereinabove each have different kinds of slits, respectively. However, it is possible that the stick-shaped material propelling device of the present invention to have a combination of slits 14, 17, 18.

While the principles of the invention have been described above in connection with specific embodiments, and particular modifications thereof, it is to be clearly understood that this description is given only by way of example and not as a limitation on the scope of invention.

What is claimed is:

1. A stick-shaped material propelling device comprising a first tubular body; a spiral shaft inserted in the first tubular body, said spiral shaft having an integral guide portion at a rear portion of the spiral shaft, said integral guide potion engaging an inside portion of the first tubular body so that the spiral shaft is unturnable, but is movable in an axial direction relative to the first tubular body; a spiral groove on the circumference of the spiral shaft; a holder for holding a stick-shaped material, said holder being provided at a front portion of the spiral shaft; a second tubular body turnably mounted on the first tubular body having a projection on the inside of a rear portion thereof, said spiral shaft and said holder being inserted in the second tubular body so as to be able to slide in the second tubular body with said projection engaging the spiral groove; a rear end of the second tubular body having two divergent concentric tubular portions including an inner tubular portion, the inner tubular portion of the second tubular body having said projection on the inside of a rear portion thereof and at least one slit formed around the projection on the inner tubular portion of the second tubular body.

2. The stick-shaped material propelling device according to claim 1, including at least one axial key groove formed on an inside portion of the first tubular body; said guide portion having at least one key adapted to engage said key groove on the inside portion of the first tubular body.

3. The stick-shaped material propelling device according to claim 1, including at least one key formed on an inside portion of the first tubular body; and said guide portion having at least one axial key groove to receive said key on the inside portion of the first tubular body.

4. A stick-shaped material propelling device comprising a first tubular body; a spiral shaft inserted in the first tubular body, said spiral shaft having an integral guide portion at a rear portion of the spiral shaft, said integral guide portion engaging an inside portion of the first tubular body so that the spiral shaft is unturnable, but is movable in an axial direction relative to the first tubular body; a spiral groove on the circumference of the spiral shaft; a holder for holding a stick-shaped material, said holder being provided at a front portion of the spiral shaft; a second tubular body turnably mounted on the first tubular body having a projection on the inside of a rear portion thereof, said spiral shaft and said holder being inserted in the second tubular body so as to be able to slide in the second tubular body with said projection engaging the spiral groove; at least one slit formed in a rear end portion of the spiral shaft; at least one key formed on an inside portion of the first tubular body; said integral guide portion having at least one axial key groove for receiving said at least one key on an inside portion of the first tubular body, the at least one axial key groove in the integral guide portion being slit formed at the rear end portion of the spiral shaft, and said at least one key on the inside portion of the first tubular body engaging the slit so that the spiral shaft is unturnable, but is movable in the axial direction relative to the first tubular body.

5. A stick-shaped material propelling device comprising a first tubular body; a spiral shaft inserted in the first tubular body, said spiral shaft having an integral guide portion at a rear portion of the spiral shaft, said integral guide portion engaging an inside portion of the first tubular body so that the spiral shaft is unturnable, but is movable in an axial direction relative to the first tubular body; a spiral groove on the circumference of the spiral shaft; a holder for holding a stick-shaped material, said holder being provided at a front portion of the spiral shaft; a second tubular body tunably mounted on the first tubular body having a projection on the inside of a rear portion thereof, said spiral shaft and said holder being inserted in the second tubular body so as to be able to slide in the second tubular body with projection engaging the spiral groove; at least one slit formed in a rear end portion of the spiral shaft; at least one key formed on an inside portion of the first tubular body; said integral guide portion having at least one axial key groove for receiving said at least one key on an inside portion of the first tubular body, one key, the at least one axial key groove on the integral guide portion comprised of the slit formed at a rear end portion of the spiral shaft and at least one groove formed in the side of the spiral shaft communicating with said slit; and said key on the inside portion of first tubular body engaging the slit and the groove so that the spiral shaft is turnable, but is movable in the axial direction relative to the first tubular body.

6. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; and slit means formed to allow relative displacement between a portion of said spiral shaft and said second tubular body during assembly; said slit means comprising at least one slit in an end portion of said spiral shaft constructed to allow said end portion to bend during assembly.

7. The stick-shaped material propelling device according to claim 6 including at least one axial key groove formed on an inside portion of said first tubular body; said guide portion having at least one key adapted to engage said at least one axial key groove.

8. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; and slit means formed to allow relative displacement between a portion of said spiral shaft and said second tubular body during assembly; said slit means comprising at least one slit formed around said projection and at least one slit formed in an end of said spiral shaft whereby said projection and said end of said spiral shaft may bend during assembly.

9. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; at least one axial key groove formed on said spiral shaft; and at least one key formed on the inside of said first tubular body adapted to engage said at least one axial key groove; said at least one key groove in said spiral shaft is at least one slit formed in the end of said spiral shaft; said at least one slit formed to allow relative displacement between a portion of said spiral shaft and said second tubular body during assembly; said at least one key on the inside of said first tubular body engaging said at least one slit preventing rotation but allowing axial movement of said spiral shaft.

10. The stick-shaped material propelling container according to claim 9 in which said at least one slit includes at least one slit formed around said projection to allow said projection to bend during assembly.

11. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; at least one axial key groove formed on said spiral shaft; and at least one key formed on the inside of said first tubular body adapted to engage said at least one axial key groove; said at least one key groove in said spiral shaft comprises; at least one slit in the end of said spiral shaft and at least one key groove in the side of said spiral shaft coextensive with said at least one slit in the end of said spiral shaft for receiving said at least one key on the inside of said tubular body to prevent rotation while allowing axial movement of said spiral shaft; said at least one slit formed to allow relative displacement between a portion of said spiral shaft and said second tubular body during assembly.

12. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; at least one axial key groove formed on said spiral shaft; and at least one key formed on the inside of said first tubular body adapted to engage said at least one axial key groove; slit means formed to allow relative displacement between a portion of said spiral shaft and said second tubular body during assembly; said slit means comprises at least one slit formed around said projection to allow said projection to bend during assembly.

13. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; at least one axial key groove formed on said spiral shaft; and at least one key formed on the inside of said first tubular body adapted to engage said at least one axial key groove; slit means formed to allow relative displacement between a portion of said spiral shaft and said second tubular body during assembly; said slit means comprising at least one slit in an end portion of said spiral shaft constructed to allow said end portion to bend during assembly.

14. A stick-shaped material propelling device comprising; a first tubular body; a spiral shaft having a circumferential spiral groove inserted in said first tubular body; a guide portion integrally formed in said spiral groove at a rear portion of said spiral shaft, said guide portion engaging an inside portion of said first tubular body to prevent said spiral shaft from rotating while allowing axial movement; a holder at a forward portion of said spiral shaft for holding a stick-shaped material; a second tubular body rotatably mounted on said first tubular body; a projection formed on the inside of a rear portion of said second tubular body; said spiral shaft being slidably inserted in said second tubular body with said projection engaging said spiral groove; at least one axial key groove formed on said spiral shaft; and at least one key formed on the inside of said first tubular body adapted to engage said at least one axial key groove; slit means formed to allow relative displacement between a portion of said spiral shaft and said second tubular body during assembly; said slit means comprising at least one slit on one slit formed around said projection and at least one slit formed in an end of said spiral shaft whereby said projection and said end of said spiral shaft may bend during assembly.

* * * * *